US010291987B2

(12) United States Patent
Gu et al.

(10) Patent No.: US 10,291,987 B2
(45) Date of Patent: May 14, 2019

(54) VIBRATION DIAPHRAGM

(71) Applicant: AAC Technologies Pte. Ltd., Singapore (SG)

(72) Inventors: Xiaojiang Gu, Shenzhen (CN); Lei Wang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/830,413

(22) Filed: Dec. 4, 2017

(65) Prior Publication Data

US 2018/0367906 A1 Dec. 20, 2018

(30) Foreign Application Priority Data

Jun. 20, 2017 (CN) ..... 2017 2 0722796 U

(51) Int. Cl.

| | |
|---|---|
| ***H04R 9/06*** | (2006.01) |
| ***H04R 7/12*** | (2006.01) |
| ***H04R 7/18*** | (2006.01) |
| ***H04R 7/14*** | (2006.01) |
| ***H04R 7/20*** | (2006.01) |

(52) U.S. Cl.

CPC ..... *H04R 7/122* (2013.01); *H04R 7/127* (2013.01); *H04R 7/14* (2013.01); *H04R 7/18* (2013.01); *H04R 7/20* (2013.01); *H04R 9/06* (2013.01); *H04R 2207/021* (2013.01); *H04R 2307/207* (2013.01); *H04R 2400/11* (2013.01)

(58) Field of Classification Search

CPC ..... H04R 7/04; H04R 7/122; H04R 7/127; H04R 7/18; H04R 9/025; H04R 9/047; H04R 9/06; H04R 2207/021; H04R 2400/13; H04R 7/14

USPC ..... 381/398, 399, 408, 423, 424, 430, 431; 181/157, 165, 166

See application file for complete search history.

(56) References Cited

U.S. PATENT DOCUMENTS

| | | | | |
|---|---|---|---|---|
| 4,484,037 A * | 11/1984 | Nieuwendijk | ..... | H04R 9/047 381/176 |
| 8,031,902 B2 * | 10/2011 | Takewa | ..... | H04R 7/04 381/399 |
| 8,379,907 B2 * | 2/2013 | Yan | ..... | H04R 7/04 381/396 |
| 2016/0112804 A1 * | 4/2016 | Xiao | ..... | H04R 9/025 381/398 |

* cited by examiner

*Primary Examiner* — Huyen D Le

(74) *Attorney, Agent, or Firm* — Na Xu; IPro, PLLC

(57) ABSTRACT

The present disclosure provides a vibration diaphragm. The vibration diaphragm includes a vibration part; a suspension extending from and surrounding the vibration part; and a pattern module part formed on the vibration part. The pattern module part includes a first protrusion, and a second protrusion bounded by the first protrusion. The first protrusion has a pair of first sides parallel to a long axis of the vibration diaphragm and a pair of second sides parallel to a short axis for connecting ends of the first sides. One of the second sides connects with the ends of the first sides via two arcs. By virtue of the configuration of the pattern module part, the solution described by the present embodiment increases the surface area of the vibration part, and widens the bandwidth of the vibration diaphragm, and further improves the acoustic performance of the diaphragm.

6 Claims, 2 Drawing Sheets

VIBRATION DIAPHRAGM

FIELD OF THE PRESENT DISCLOSURE

The present disclosure relates to electro-acoustic transducers, more particularly to a vibration diaphragm for radiating audible sounds.

DESCRIPTION OF RELATED ART

With the rapid development of portable devices like mobile phone etc, people's requirement to the performance of the product is becoming stronger and stronger, and there is a vibration mode of music belt for the music appreciation of the mobile phone, in order to strengthen the entertaining effect, thus, the development of the sounding instrument is accelerating accordingly.

The sounding instrument with relevant technology comprises a frame, a vibration diaphragm supported on the frame and a voice coil driving the vibration of the vibration diaphragm. The vibration diaphragm comprises a dome and a suspension extending along the dome, and the voice coil is fixed on the suspension.

However, in the vibration diaphragm with relevant technologies, the dome is a simple plane structure, and this structure makes the acoustic performance of the vibration diaphragm not improved further, and affects badly the acoustic performance of the vibration diaphragm.

Therefore it is necessary to provide an improved vibration diaphragm for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
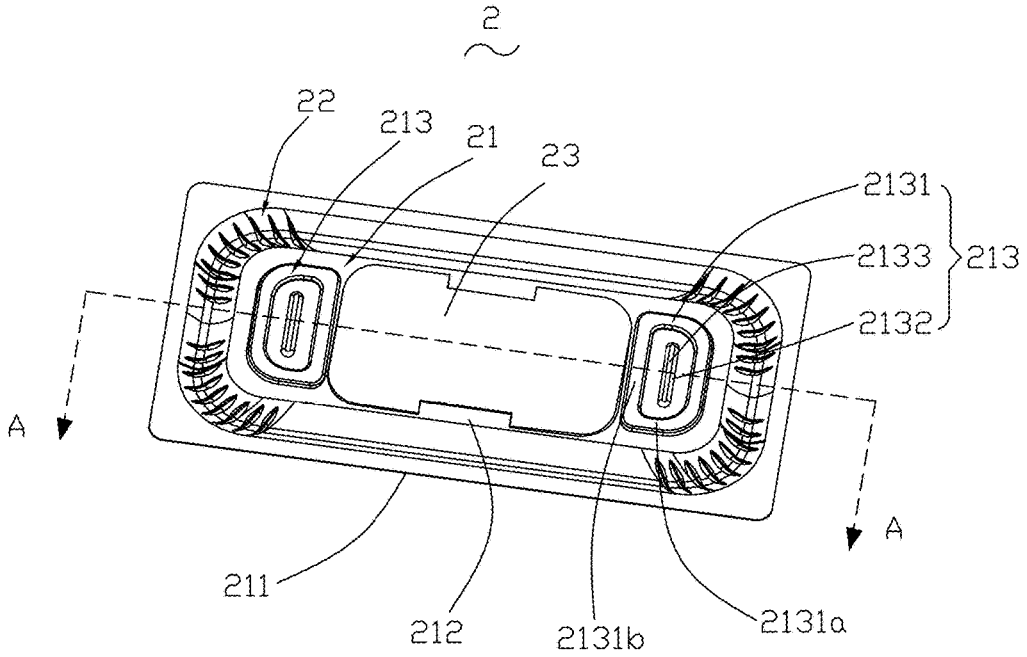
FIG. 1 is an illustrative isometric view of a vibration diaphragm in accordance with an exemplary embodiment of the present disclosure.
Figure 2:
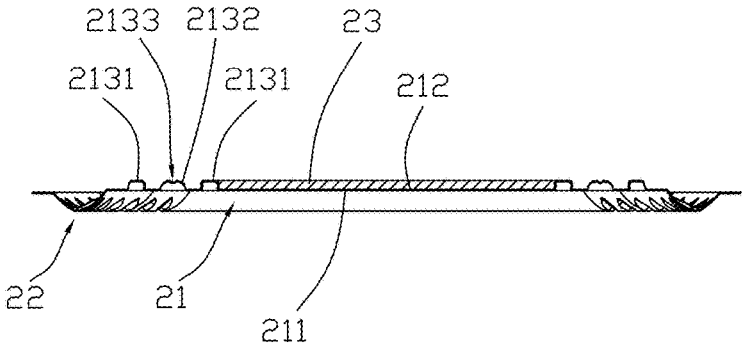
FIG. 2 is a cross-sectional view of the vibration diaphragm in FIG. 1, taken along line A-A.

Referring to FIGS. 1-2, a vibration diaphragm 2 in accordance with an exemplary embodiment of the present disclosure is disclosed. The vibration diaphragm 2 has a geometric center, and includes a vibration part 21, a suspension 22 extending from and surrounding the vibration part 21, and a dome 23 attached to the vibration part 21.

The vibration art 21 includes a bottom surface 211, a top surface 212 opposed to the bottom surface 21, and a pattern module part 213.

The pattern module part 213 is formed on the bottom surface 211 and/or the top surface 212. Further, the pattern module part 213 is formed by being concave or convex from the top surface 212 or the bottom surface 211.

In this embodiment, the pattern module part 213 includes a first protrusion 2131, a second protrusion 2132, and a recess 2133. The first protrusion 2131 surrounds the second protrusion 2132 for forming a gap therebetween. In other words, the first protrusion 2131 keeps a distance from the second protrusion 2132. The second protrusion 2132 locates in an area bounded by the first protrusion 2131. The recess 2133 is formed on the second protrusion 2132. Preferably, the first protrusion 2131 is a ring, and the second protrusion 2132 is a strip bounded by the first protrusion 2131. In the embodiment, the first protrusion 2131 is convex along a direction from the bottom surface 211 toward the top surface 212. The second protrusion 2132 is convex along the same direction. While, the recess 2133 is concave along a direction form the top surface toward the bottom surface. According to FIGS. 1-2, the first protrusion 2131 has a pair of first sides 2131*a* parallel to a long axis of the vibration diaphragm 2 and a pair of second sides 2131*b* parallel to a short axis of the vibration diaphragm 2 for connecting ends of the first sides 2131*a*. One of the second sides 2131*b* relatively far away from the geometric center connects with the ends of the first sides 2131*a* via two arcs. A length of the first side 2131*a* is smaller than a length of the second side 2131*b*, and a length of one of the second sides 2131*b* relatively closer to the geometric center is greater than a length of the other second side 2131*b*. The second protrusion 2132 is parallel to the long side of the first protrusion 2131. The recess 2133 is used for reducing deformation of the pattern module part 213 and for enhancing the strength of the pattern module part, and further for improving the stability of the vibration diaphragm 2.

Optionally, the vibration diaphragm 2 includes two pattern module part 213 symmetrical about the short axis the vibration diaphragm 2 for ensuring the balance of the vibration of the diaphragm.

The pattern module part 213 increases the surface area of the vibration part 21, and widens the bandwidth of the vibration diaphragm 2, and further improves the acoustic performance of the diaphragm. In this embodiment, the suspension is a concave form toward the bottom surface 211.

The dome 23 is fixed to the top surface 212 of the vibration part 21, and locates between the two pattern module part 213.

Figure 3:
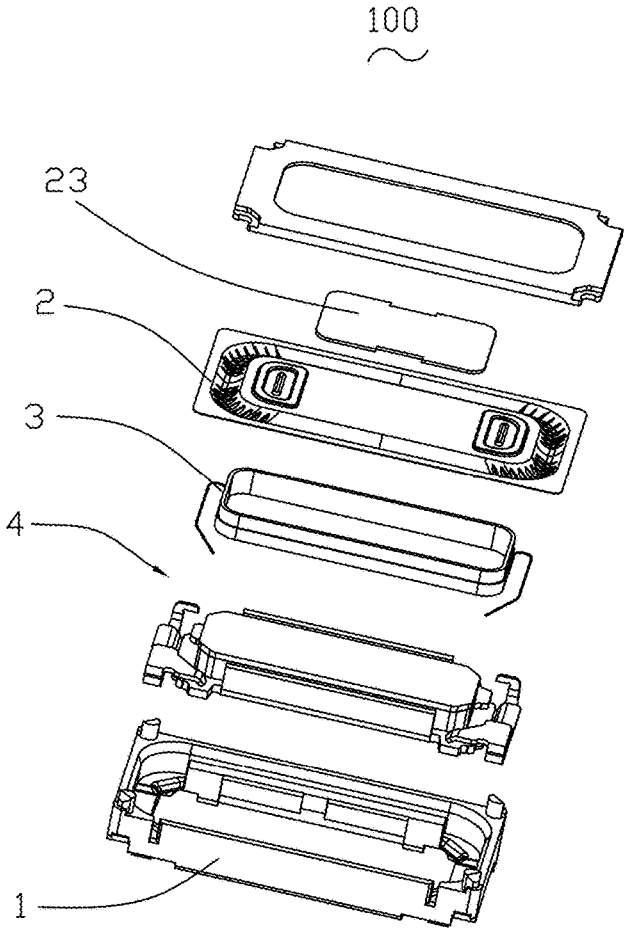
FIG. 3 is an exploded view of a sound generator using the vibration diaphragm in FIG. 1.

Referring to FIG. 3, the present disclosure further discloses a sound generator 100 including a frame 1, a vibration diaphragm 2 supported by the frame 1, a voice coil 3 for driving the vibration diaphragm 2, and a magnetic circuit system 4 positioned by the frame 1. The voice coil 3 is fixed by the vibration part 21 of the vibration diaphragm 2.

By virtue of the configuration of the pattern module part, the solution described by the present embodiment increases the surface area of the vibration part, and widens the bandwidth of the vibration diaphragm, and further improves the acoustic performance of the diaphragm.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A vibration diaphragm having a geometric center, comprising:

a vibration part;

a suspension extending from and surrounding the vibration part;

a pattern module part formed on the vibration part, the pattern module part including a first protrusion, a second protrusion bounded by the first protrusion, and a gap formed between the first protrusion and the second protrusion;

the first protrusion having a pair of first sides parallel to a long axis of the vibration diaphragm and a pair of second sides parallel to a short axis of the vibration diaphragm for connecting ends of the first sides; wherein one of the second sides relatively far away from the geometric center connects with the ends of the first sides via two arcs, the pattern module part further includes a recess formed on the second protrusion.

2. The vibration diaphragm as described in claim 1, wherein a length of the first side is smaller than a length of the second side.

3. The vibration diaphragm as described in claim 2, wherein a length of one of the second sides relatively closer to the geometric center is greater than a length of the other second side.

4. The vibration diaphragm as described in claim 3 including two pattern module parts symmetric about the short axis of the vibration diaphragm.

5. The vibration diaphragm as described in claim 4 further including a dome attached to the vibration diaphragm and located between the two pattern module parts.

6. A sound generator, including:

a frame;

a vibration diaphragm as described in claim 1 supported by the frame; and a voice coil for driving the vibration diaphragm.

* * * * *